US006015586A

United States Patent [19]

Omori et al.

[11] Patent Number: 6,015,586

[45] Date of Patent: Jan. 18, 2000

[54] COLD DRY PLATING PROCESS FOR FORMING A POLYCRYSTALLINE STRUCTURE FILM OF ZINC-IRON BY MECHANICAL PROJECTION OF A COMPOSITE MATERIAL

[75] Inventors: Shigeru Omori, Okayama, Japan; Jean Marie Kieffer, Obernai, France

[73] Assignee: Acheson Industries, Inc., Port Huron, Mich.

[21] Appl. No.: 09/026,330

[22] Filed: Feb. 19, 1998

[51] Int. Cl.[7] ..... B05D 3/14

[52] U.S. Cl. ..... 427/11; 427/192; 427/216; 427/217; 427/242; 427/345

[58] Field of Search ..... 427/11, 192, 216, 427/217, 242, 345

[56] References Cited

U.S. PATENT DOCUMENTS

| | | | |
|---|---|---|---|
| Re. 23,861 | 8/1954 | Clayton | 117/109 |
| 2,149,253 | 3/1939 | Cooper | 29/90 |
| 2,640,002 | 5/1953 | Clayton | 117/109 |
| 3,447,950 | 6/1969 | Evans et al. | 117/100 |
| 3,754,976 | 8/1973 | Babecki et al. | 117/105 |
| 3,765,923 | 10/1973 | Bender-Christensen | 117/26 |
| 4,714,622 | 12/1987 | Omori et al. | 427/11 |
| 5,302,414 | 4/1994 | Alkhimov et al. | 427/192 |
| 5,354,579 | 10/1994 | Watanabe et al. | 427/216 |

*Primary Examiner*—Shrive Beck
*Assistant Examiner*—Paul D. Strain
*Attorney, Agent, or Firm*—Dinnin & Dunn, P.C.

[57] ABSTRACT

High efficiency cold dry plating method for forming an important and highly adherent polycrystalline structured zinc alloy film on metallic substrates by mechanical projection of a composite material.

High efficiency cold dry plating method using a composite material described as iron nuclei particles encapsulated by zinc alloy, where the composite material contains 45 to 80% of zinc.

Cold dry plating process giving improved yield and short treatment time with high amount of zinc strongly adherent on metallic surfaces.

9 Claims, 1 Drawing Sheet

COLD DRY PLATING PROCESS FOR FORMING A POLYCRYSTALLINE STRUCTURE FILM OF ZINC-IRON BY MECHANICAL PROJECTION OF A COMPOSITE MATERIAL

BACKGROUND OF THE INVENTION (Novel Process For Composite Material Application)

1. Field of the Invention

The invention describes a new dry plating process with high efficiency used to form with high yield, in a short time, an important film of polycrystalline structure zinc-iron alloy on the surface of metallic substrates; mainly iron, iron alloys, stainless steel and titanium.

The coating of the metallic surface is obtained by mechanical projection of selected composite material in defined conditions, in order to reduce the treatment time, to decrease the dust formation, and globally increase the yield of the treatment.

2. Prior Art

The conventional mechanical plating method to form a zinc film on the surface of metallic substrates is described in prior patents, U.S. Pat. No. 4,655,832 and U.S. Pat. No. 4,714,622; these methods use either a mixture of zinc alloy and steel shots or an ejection material which is projected or blasted onto the substrate.

In all the earlier described methods of dry plating, the treatment time is long, the ejections of material are multiple, the yield of the transfer of the zinc or zinc alloy on to the surface of the substrate is low, and the earlier described processes generate overly high amounts of wastes.

It has been discovered that some of the main factors influencing directly the efficiency of the process are: (1) the nature of the material used for zinc dry plating; and (2) the projection process of the ejection material on the substrate.

SUMMARY OF THE INVENTION

The cold dry plating method discovered and disclosed herein is of great interest in metallic surface treatment since dry conditions of processing do not induce and do not require waste water disposal (electro galvanizing method). The amount of metallic substrates treated by cold dry plating method has in the past been limited due to an unsatisfactorily low yield from the process:

(a) the current dry plating system using the conventional ejection powders induce the formation of a significant quantity of zinc dust;

(b) the current dry plating equipment needs a continuous purification system of the ejection powder during the processing and need elimination of the zinc dust to avoid dust explosions;

(c) the continuous system of dust separation and ejection powder particles purification induce a low yield for the process and long treatment times.

In order to solve the above mentioned problems, the present invention describes an improved method for projecting a selected ejection powder named composite material for cold dry plating of metallic substrates, wherein the improved process for composite material application uses high mechanical energy to provoke an efficient shock of the composite material on to the substrate's surface for a high adhesion of the zinc onto the metallic surface; and, wherein the projection angle is optimized to decrease the quantity of zinc dust developed during the high energy projection process;

wherein the projection distance is minimized to have an efficient participation of the small particles contained in the composite material with resultant improved mechanical shocks during the process;

wherein the projection distance and the projection angle are uniquely adjusted to minimize the dust production during the process;

wherein the energy of ejection is uniquely adjusted to have an efficient participation to the film formation of the small particles developed during the process;

wherein the working conditions are adjusted to be in safe and secure conditions when considering and avoiding the possibility of dust explosion;

wherein the working conditions are uniquely adjusted to create the minimum zinc dust during the process, zinc dust being generated by inefficient shocks of composite material onto the metallic substrates, and therefore, the global yield of the process is greatly improved by minimizing the zinc dust wastes;

wherein the use of a high energy projection process associated with an adjusted projection angle lead the generated zinc dust to uniquely participate to the film formation and increase the global adhesion efficiency of the process; and wherein the projection angle is comprised broadly between about 40 and 90°, preferably between 65 and 90° or, best results being obtained, between about 75 and 90°.

In the prior art method of manufacture of ejection powders, the zinc alloy surrounding the iron alloy particles are composed of several different phases without any control of the amount of these different phases in the zinc alloy. This earlier technique of ejection powders used for dry plating is disclosed in U.S. Pat. No. 5,354,579 where a thermal treatment is applied to the ejection powders to increase HV hardness of the zinc alloy around the iron alloy nucleus. The zinc alloy content of the ejection powders described in the prior patents disclosed above is 42% maximum but, in practice, due to difficulties of processing the particle size reduction zinc is lost, and in reality the ejection powders contain only between 32 and 40% of zinc. In view of the earlier prior art above, it has been unexpectedly discovered that a thicker zinc alloy film can be obtained on the surface of metallic substrates with the use of the composite material described in the present invention. Thus, the metallic surfaces can be treated more efficiently and easily; and the zinc alloy film can be formed efficiently with a smaller amount of composite material and a smaller number of blastings which significantly reduces the surface treatment cost through use of the present invention.

The percent (%) amounts of all ingredients herein are given in weight % unless otherwise stated.

DESCRIPTION OF PREFERRED EMBODIMENTS

EXAMPLE 1

Figure 1:
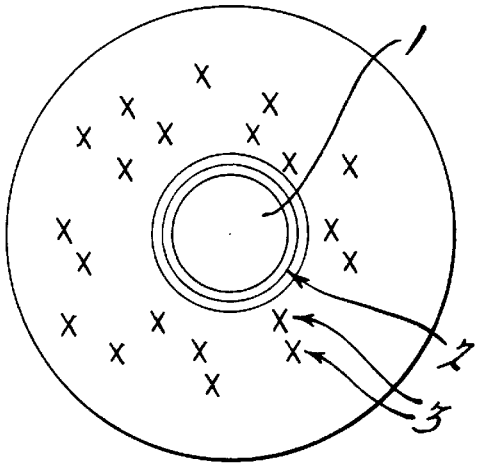
FIG. 1 and FIG. 1*a* illustrate the special composite material, pursuant to the invention, which is in generally spherical shape with a multilayer structure.

Preparation of the Composite Material 50 kg of zinc alloy containing 97% of Zn and 3% of aluminum (Al) are melted and the temperature is maintained at about 580° C.

8 kg of stainless steel particles (SUS 305) of a mean diameter of about 1.5 mm are added in the stirred melt. The mixture is then heated to reach 580° C. and 25 kg of iron alloy particles are added (Table 1 below gives composition and particle size of iron alloy particles). The mixture is stirred for 15 minutes and removed from the reaction crucible as soon as viscosity increases for a rapid air cooling. The product is crushed and screened by a sieve of 1.0 mm opening. All the particles with a diameter larger than 1.0 mm are the stainless steel particles added to the molten zinc alloy.

Table 2 indicates the particle size distribution and chemical composition of the composite material produced.

TABLE 1

| Iron Alloy Particle | | | Chemical Composition | | |
|---|---|---|---|---|---|
| +500μ | 250μ | 150μ | Fe | C | Mn |
| 1% | 63% | 36% | 97.7% | 0.8% | 1.0% |

TABLE 2

| Particle Size Of The Composite Material | | | Chemical Composition Of The Composite Material | | |
|---|---|---|---|---|---|
| 1000μ | 250μ | 150μ | Zn | Fe | Al |
| traces | 88.2% | 11.5% | 67.5% | 31.4% | 2.1% |

EXAMPLE 2

Of Cold Dry Plating

The composite material manufactured according to the present invention description above, is compared to an earlier commercially available ejection powder using an air blaster (air pressure 5 atm with 5 mm nozzle). The amount of material blasted is 500 g and the nozzle-substrate distance is 140 mm. The test consists in measuring the deposit of the zinc alloy on the substrate after different numbers of blastings. The zinc alloy amount deposed on the substrate is measured by a gravimetric method: determination of the weight of the dry coated substrate before and after alkaline peeling off.

Table 3 indicates the amount of film formed in function of the number of blastings using the composite material of the present invention and a commercial product.

TABLE 3

| Amount Of Film ($mg/dm^2$)/Number Of Ejections | | | | | | |
|---|---|---|---|---|---|---|
| Number Of Blastings | 1 | 5 | 10 | 15 | 20 | 25 |
| Composite Material Of The Present Invention | 151 | 174 | 193 | 196 | 160 | 148 |
| Commercial Product | 157 | 127 | 105 | 94 | 78 | 69 |

Aluminum is added in an amount not exceeding 5% by weight of the zinc content, more preferably 3%, for two reasons: (1) aluminum absorbs preferably on the iron alloy, and reacts to form a defined compound $Fe\ Al_3$ acting as a diffusion barrier and limits the reaction of iron with the liquid zinc alloy; and (2) the second effect of the aluminum is to improve the corrosion resistance of the polycrystalline structured film obtained by cold dry plating method using the described inventive composite material.

When the composite material of this invention is used for cold dry plating, an excellent coating film with a strong anchorage to the substrate, a high coating amount, and a superior corrosion resistance is obtained, especially on iron, iron alloy, stainless steel and titanium substrates.

An inert substance for a good control of the reaction of alloying zinc to iron is added into the zinc melt containing 5%, or better 3%, of aluminum before addition of the iron alloy particles. The inert substance is defined as a material which does not, or is difficult to be, alloyed with zinc or zinc alloys, and with a melting point higher than 700° C.

The inert substance is added to the molten zinc alloy in a proportion of about 5 to 50% of the total preparation of the composite material, and preferably within the range of about 10% to 45% by weight.

The inert substance has an average particle size approximately 1.5 times to 5 times larger (preferably about 2.5 to 4.5 times larger) than the iron alloy particles used for the reaction and have to be non reactive with any material entering in the composition of the composite material.

In the present invention, the inert substance is selected from the group consisting of ceramic particles and/or stainless steel particles.

Preferably they are stainless steel particles. The stainless steel particles type particularly suitable for this application is stainless steel type SUS 305.

The reaction of alloying iron to zinc to form a defined alloy composition $Fe\ Zn_{13}$ and $Fe\ Zn_7$ encapsulating iron alloy particles is carried at a temperature between about 470° C. and 700° C., by adding to the molten zinc with an efficient stirring the inert substance and afterwards, the iron alloy particles. The reaction is carried on until an increase of viscosity of the reaction mixture is observed; and at this point, the reaction mixture is rapidly cooled to stop further alloying reaction of zinc and iron.

The viscosity increase of the reaction mixture is due to the progressive diminution of the quantity of molten zinc alloy which is reacting with the iron and crystallizes on the iron alloy particles. Therefore, the iron alloy particles are rapidly encapsulated by the zinc-iron alloy and simultaneously their diameter is growing. The inert substance added to the reaction mixture avoids the encapsulated iron alloy particles to stick together and allow the mixture to stay in a semi-fluid form. When the increase of viscosity of the reaction mixture is observed, it indicates that the majority of the zinc available for reaction has been transformed to $Fe\ Zn_{13}$ and $Fe\ Zn_7$ and the reaction has to be stopped by rapid cooling. If the reaction is not stopped at the right time, the alloying of zinc and iron continues and the zinc-iron alloy composition becomes richer in iron. such a product has a poor efficiency in a cold dry coating process because the zinc content of the layer encapsulating the iron alloy particle is low.

DETAILED DESCRIPTION OF THE INVENTION

The cold dry plating method for forming a polycrystalline film of zinc-iron alloy on metallic substrates using a composite material consists in a continuous process of projection of the described composite material on the substrate.

The continuous projection process consists in giving enough energy to the composite material in order to provoke an effective shock of the material on the substrate and to cause the transfer of the zinc-iron alloy from the composite material to the substrate surface.

A continuous cold dry plating consists in an efficient system of projection of the composite material with a magnetic separation of the iron alloy particles after transfer of all the zinc alloy on the substrate.

The design of the system of projection of the composite material is done in such a way as to minimize the distance between the projection system and the substrate surface and to have a preferred projection angle of the composite material on the surface near 80–90°.

The design of the recycling equipment of composite material is realized to have continuous projection of efficient material: therefore, the particles of composite material which have transferred all their zinc-iron alloy to the substrate are separated magnetically and all the small particles of a diameter of 2 to 3 microns generated by the shocks during the projection process are separated from the recycled material and blocked in a dust separator.

Figure 1A:
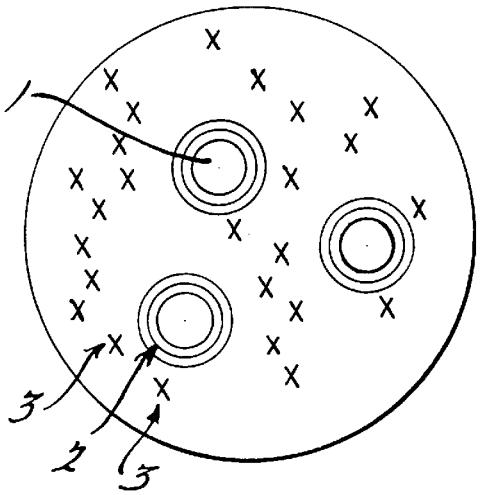

The composite material used for cold dry plating is a mixture of mono nucleus iron alloy particle encapsulated by a zinc iron alloy (simply referred to as mono nucleus particles) and zinc-iron alloy encapsulating several iron alloy particles (simply referred to as poly nuclei particles), FIG. 1 and FIG. 1*a*.

As specifically described in the working example No. 1 above, when compared with the earlier conventional ejection powders, especially those using zinc or zinc alloy as the coating material, the composite material of this invention has higher adhesivity to the surface to be treated, is able to form a strong polycrystalline structured coating film with a higher coating amount, and a defined composition of the zinc-iron alloy. In order to achieve such effects, the composite material must satisfy the conditions specified below.

The composite material is composed of mono nucleus particles and poly nuclei particles, the first consisting in one single iron alloy particle encapsulated by a zinc-iron alloy and the second type of particles are composed by several iron alloy particles encapsulated by a zinc-iron alloy (see FIG. 1 and FIG. 1*a*).

The composite material has total zinc content between 45% and 80%, aluminum content between 1.4 and 2.4% and a total concentration of the three elements copper, magnesium and tin, between about 2.3 and 4.0% (preferably between about 2.5% and 3.8%), the balance being iron alloy and incidental impurities.

The zinc-iron alloy encapsulating the iron alloy particles is composed of two defined compounds: Fe $Zn_{13}$ and Fe $Zn_7$ comprising 6% to 13% Fe, not more than 5.0% Al, and not more than 5% of Cu+Mg+Sn; the balance being Zn and incidental impurities.

The iron alloy particles encapsulated have a typical chemical composition of Fe 97.7%, C 0.8%, Mn 1.0% and a micro Vickers hardness of 790 HV at least.

The shape of the iron alloy particles has to be free of sharp angles, regular and with multiple facets; and better they have to be spherical.

This addition of an inert substance to the molten zinc or zinc alloy allows a good control of the reaction of diffusion of the iron into the molten zinc alloy according to the reaction:

$$\underset{\text{Zn alloy}}{\text{Zn or}} + \text{Fe} \;==>\; \underset{\text{Zinc-iron alloy}}{\text{Fe Zn}_{13} + \text{Fe Zn}_7}$$

The two defined substances and Fe $Zn_{13}$ and Fe $Zn_7$ are developed on the surface of the iron or iron alloy nuclei and encapsulate the iron or iron alloy particle by cocrystallization on the iron alloy nucleus.

Thus, the iron or iron alloy particles are encapsulated by an homogeneous layer of a zinc-iron alloy of defined composition containing between about 6% and 13% of iron.

The inert substance acts as a reaction controller and also prevents or avoids the iron or iron alloy encapsulated particles to stick strongly together. When the reaction of encapsulation is finished, the reaction mixture is cooled, crushed and afterwards, milled; at this step, the inert substance acts as an assistance for particle separation, and therefore, allows the manufacture of a composite material with a narrow particle size distribution in the range of about 40 to 2000 microns with an uniform zinc-iron alloy layer covering the spherical iron or iron alloy nuclei.

Function

A composite material described as a powder containing mono nucleus iron alloy particle encapsulated by zinc iron alloy and poly nuclei iron alloy particles dispersed in a zinc-iron alloy, produced by a method according to the present invention, contains a large amount of zinc-iron alloy and, therefore, a large amount of zinc when compared with the earlier conventional ejection material.

The cold dry zinc alloy plating method refers to a process of projection of the composite material onto the surface of a substrate to be treated to operate a transfer of the zinc or zinc alloy from the composite material to the surface of the substrate.

The particles of the composite material collide against the surface to be treated with a high energy (high speed). The surface of the composite material coming in close contact with the substrate is bonded to the substrate and separates from the rest of the composite material. In order to have a good transfer or the zinc iron alloy from the composite material on to the substrate surface, it is necessary that the bonding strength of the zinc-iron alloy to the substrate is greater than the breaking strength of zinc-iron alloy from the composite material. The transfer is improved by the presence of the release layer of Fe $Al_3$ on the iron core.

It has been discovered that the method of production of the composite material uniquely achieves this effect of differential strength between the bonding strength of zinc-iron alloy to the substrate surface and the breaking strength of the zinc-iron alloy from the composite material.

This effect is achieved by a good control of the reaction allowing a defined composition of the zinc-iron alloy: Fe $Zn_{13}$ and Fe $Zn_7$, wherein during the cooling of the composite material after manufacture, intergranular fractures occurs at the grain boundaries into the zinc iron alloy structure and, therefore, the breaking strength is reduced.

The harder the zinc alloy particles with an iron alloy nucleus are, the easier is the transfer of zinc alloy onto the substrate: but the building of a film of zinc alloy is limited by the abrasion due to the hardness of the zinc alloy. The hardness of zinc alloy is suitable for the easy transfer of zinc alloy from the ejection powder on to the substrate, but the hardness of the zinc alloy is a significant factor for limitation of the importance of the zinc alloy film formation on the substrate.

Therefore, when ejection powders thus obtained are used for mechanical plating, the quantity of zinc alloy adhering to the substrate has a limitation: when the number of applications is increased, the quantity of zinc alloy fixed on the substrate decrease.

Three main factors are directly influencing the zinc alloy deposit:

- the higher is the zinc alloy concentration in the ejection powder, the higher is the adhesion of zinc alloy on the substrate;

the finer is the particle size of the ejection powder, the higher is the zinc alloy deposit; and the chemical composition of the zinc-iron alloy surrounding the iron alloy nuclei.

The amount of zinc alloy deposed on the substrate by dry plating is at present limited in the earlier prior art techniques, because the zinc alloy content of the ejection powder is limited to the range 32 to 40%; the particle size distribution is broad and the chemical composition of the zinc alloy is not really defined.

The improved zinc iron alloy film formation on metallic substrates, pursuant to this invention, uses a cold dry plating process which involves a special composite material. The special composite material has a spherical shape with a multilayer structure as shown in FIG. 1 (or FIG. 1*a*) of the drawings. The spherical core 1 is comprised of iron alloy material. The layer 2 encapsulating the spherical iron core is defined as Fe $Al_3$ and acts as a release layer to help the separation of the zinc alloy (layer 3) from the spherical iron core onto the metallic substrate during the cold plating process. The layer 3 is composed of zinc iron ally defined as a blend of Fe $Zn_{13}$ and Fe $Zn_7$.

Problems Solved

The projection material used in the past for dry plating have the following disadvantages:

a) the projection material has no defined shape, the iron particles used as cores are polygonal with sharp angles;

b) the thickness of the iron alloy layer covering the iron cores is not even, and some parts of the iron cores are not covered with zinc alloy;

c) the composition of the zinc iron alloy is not defined and the zinc content of the projection material is limited.

Therefore, when such past projection materials are used in dry film plating, the amount of zinc alloy film formed is limited: the sharp angles of the iron cores abrade the surface and the peeling off of the film takes over the film formation, and significant amounts of dust are generated during the plating process.

The present invention solves these problems through incorporation of the following:

special composite material with a spherical iron core;

special composite material with a multilayer structure;

an iron core, a release layer to facilitate the transfer of zinc alloy from the composite material to the substrate, a defined composition of the zinc iron alloy as a blend of Fe $Zn_{13}$ and Fe $Zn_7$.

The composite material with a spherical shape of steel core covered with an uniform layer of a defined composition of zinc iron alloy is projected on the surface to be treated with a speed of 30 m/s (meters/second) at least; and preferably within the range of 30 to about 100 m/s.

The shock of the composite material on the surface provokes a transfer of zinc alloy from the composite material on to the metallic surface; this transfer is made easier by the presence of the release layer 2 on the spherical iron core.

By the shock, some parts of the zinc alloy layer are broken off of the composite material and they are clad in a dotted line onto the surface.

The improvement of this invention makes the treatment much more advantageous, shortens the treatment time and reduces the formation of zinc alloy dust by using spherical particle cores.

Results

Comparison of Sticking Efficiency

Figure 2:
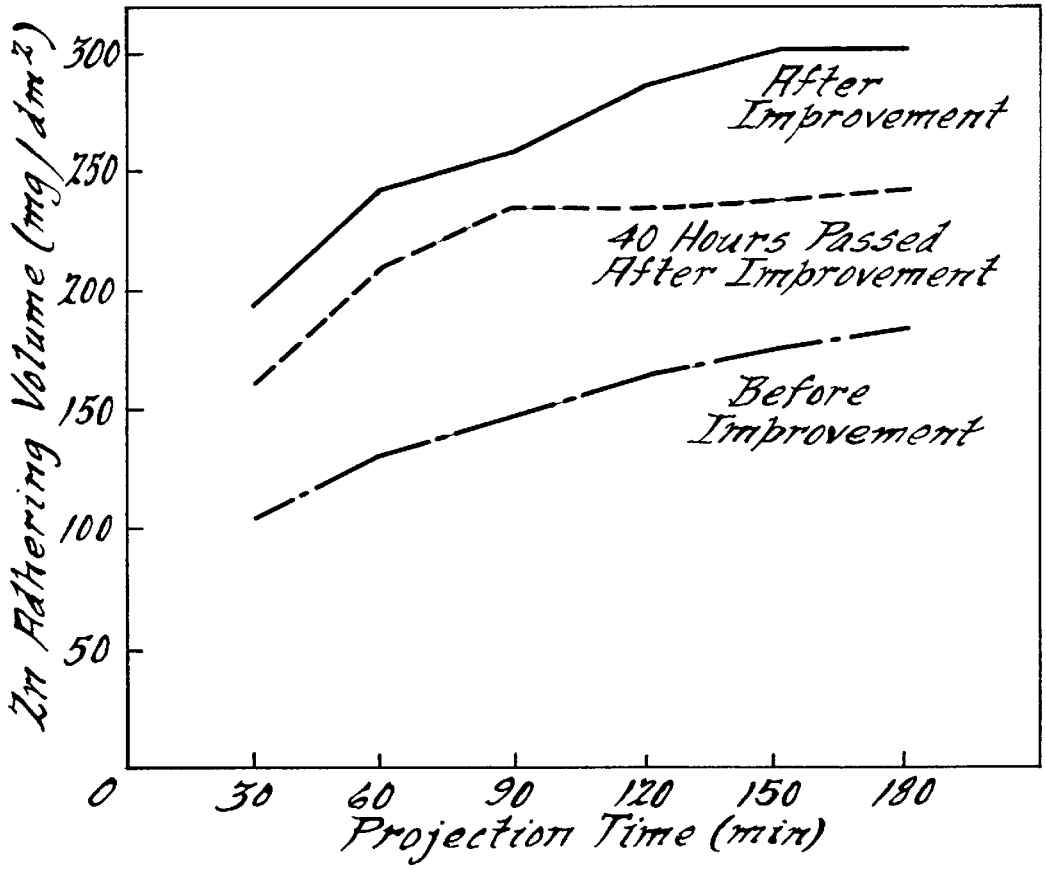
FIG. 2 shows a comparison of adhesive efficiency, comparing projection time for the prior art system versus using the improvement of this invention; and this will be discussed in more detail hereinafter in the section of results. Like numerals in different drawings illustrate like elements.

Sticking efficiency of prior art and after improvement are compared under the same test condition and same works (See FIG. 2).

Test specimen: 91511-80845 (M8 Flange bolt)

Projection volume: 100 kg

Condition: Rotor revolution—4200 rpm

Projection volume—150 kg/min

The comparison of projection time and sticking volume for the prior art system and after using the improvement of this invention is shown in the FIG. 2.

With the improvement of projection distance and angle, sticking efficiencies at immediate and 40 hours afterwards using this invention shows an improvement by 1.5 times or 150%.

Conclusion (1) Projection distance was shortened by 90 mm, from 600 mm to 510 mm.

(2) Projection angle was improved by 4.6°, from 41.9° to 46.5°.

In view of the description above, it is evident that a thicker zinc alloy film can be obtained on the surface of metallic substrates with the use of the composite material described in the present invention. The metallic surfaces can be treated more easily. The zinc alloy film can be formed efficiently with a smaller amount of composite material and a smaller number of blastings which significantly reduces the surface treatment cost.

While it will be apparent that the preferred embodiments of the invention disclosed are well calculated to fulfill the objects, benefits and/or advantages of the invention, it will be appreciated that the invention is susceptible to modification, variation and change without departing from the proper scope or fair meaning from the subjoined claims.

What is claimed is:

1. A cold dry plating process comprising the step of: projecting a composite material consisting essentially of mono nucleus particles and poly nuclei particles on to a metallic substrate to form a polycrystalline film of zinc-iron alloy on the metallic substrate, and wherein the equipment used for cold dry plating is designed for a continuous projection of composite material with a recycling of the composite material after separation of the iron alloy particles, wherein mono nucleus and poly nuclei particles are encapsulated in a zinc-iron alloy whose composition is defined as Fe $Zn_{13}$ and Fe $Zn_7$, and wherein the composite material has zinc content between 45% and 80% by weight.

2. A cold dry plating process as set forth in claim 1 wherein the equipment is designed to minimize the distance of projection of the composite material on the substrate surface and designed to have a projection angle of the composite material on to the substrate of 90°.

3. A cold dry plating process as set forth in claim 2 wherein the composite material has a narrow particle size distribution in the range of about 40 to 2000 microns.

4. A cold dry plating process as set forth in claim 2 wherein the zinc-iron alloy encapsulating an iron alloy nuclei which has a defined composition containing about 6% to 13% by weight of Fe.

5. A process of manufacturing a composite material comprising the step of: encapsulating iron alloy particles with a zinc-iron alloy, and wherein an inert substance of stainless steel in finely particulated form is added to facilitate the encapsulating and resulting in a reaction mixture, said stainless steel being added in a proportion of about 5% to about 50% by weight of the reaction mixture, and wherein the stainless steel in finely particulated form has a mean diameter of about 1.5 to 5 times larger than the iron alloy particles.

6. The product by the process of claim 5.

7. A manufacturing process to prepare composite material comprising: encapsulating iron alloy particles with a zinc-iron alloy while adding an inert substance to the reaction mixture, wherein the inert substance is added in a proportion of 5% to 50% by weight of the total reaction mixture, and wherein the inert material is stainless steel with a mean diameter 1.5 to 5 times larger than the iron alloy particles, wherein the composite material has zinc content between about 45% and 80% by weight, wherein the composite material has a narrow particle size distribution in the range of 40 to 2000 microns, and wherein the zinc-iron alloy encapsulating the iron alloy nuclei contains about 6% to 13% by weight of Fe.

8. The product by the process of claim 7.

9. A cold dry plating process comprising: projecting a composite material consisting essentially of mono nucleus particles and poly nuclei particles in order to form a polycrystalline film of zinc-iron alloy on metallic substrates, wherein the equipment used for cold dry plating is designed for a continuous projection of composite material with a recycling of the composite material after separation of the iron alloy particles, wherein mono nucleus and poly nuclei particles are encapsulated in a zinc-iron alloy whose composition is defined as Fe $Zn_{13}$ and Fe $Zn_7$, wherein the composite material has zinc content between about 45% and 80% by weight, wherein the composite material has spherical iron alloy cores, wherein the equipment is designed to minimize the distance between the projection equipment and the surface of the substrate and designed to have a projection angle of the composite material on to the substrate of about 75° to about 90°, and wherein the composite material has a narrow particle size distribution in the range of 40 to 2000 microns, and wherein the zinc-iron alloy encapsulating the iron alloy nuclei contains about 6% to 13% by weight of Fe.

* * * * *